US009011264B2

(12) United States Patent
Tang

(10) Patent No.: US 9,011,264 B2
(45) Date of Patent: Apr. 21, 2015

(54) TILTABLE/ADJUSTABLE GOLF PRACTICE DEVICE

(71) Applicant: Chen-Chung Tang, New Taipei (TW)

(72) Inventor: Chen-Chung Tang, New Taipei (TW)

( * ) Notice: Subject to any disclaimer, the term of this patent is extended or adjusted under 35 U.S.C. 154(b) by 84 days.

(21) Appl. No.: 13/930,283

(22) Filed: Jun. 28, 2013

(65) Prior Publication Data

US 2015/0005083 A1 Jan. 1, 2015

(51) Int. Cl.
*A63B 69/36* (2006.01)

(52) U.S. Cl.
CPC ..... *A63B 69/3661* (2013.01)

(58) Field of Classification Search
USPC ..... 473/278, 279
See application file for complete search history.

(56) References Cited

U.S. PATENT DOCUMENTS 5,720,670 A * 2/1998 Oxley et al. ..... 473/279
5,820,478 A * 10/1998 Wood et al. ..... 473/279
5,944,615 A * 8/1999 Lee ..... 473/279

* cited by examiner

*Primary Examiner* — Nini Legesse
(74) *Attorney, Agent, or Firm* — Rosenberg, Klein & Lee

(57) ABSTRACT

A tiltable/adjustable golf practice device includes multiple height adjusters mounted on the respective corners of the teeing ground. By means of lifting or lowering the height adjusters, the teeing ground can be tilted to simulate the landform of a real golf course in accordance with the requirement of a user in practice. The tiltable/adjustable golf practice device is free from any electronic control or hydraulic device so that the manufacturing cost is greatly lowered. Also, a user can freely remove the tiltable/adjustable golf practice device so that the application of the tiltable/adjustable golf practice device is facilitated.

14 Claims, 11 Drawing Sheets

TILTABLE/ADJUSTABLE GOLF PRACTICE DEVICE

BACKGROUND OF THE INVENTION

1. Field of the Invention

The present invention relates generally to a golf practice device, and more particularly to a tiltable/adjustable golf practice device including multiple height adjusters mounted on the respective corners of the teeing ground. By means of lifting or lowering the height adjusters, the teeing ground can be tilted to simulate the landform of a real golf course.

2. Description of the Prior Art

It is known that many golf players not only will golf on a real golf course, but also will expend more time to practice the golfing skill with a golf practice device so as to correct the teeing or putting attitude and promote the golfing skill.

A simplest conventional golf practice device is an artificial lawn paved on the ground. A player can directly stand on the artificial lawn to practice teeing or putting skill. However, a real golf course has a waved landform, which is quite different from that of a plane ground. Therefore, the artificial lawn paved on the ground can hardly simulate the landform of a real golf course. As a result, the practice effect is poor.

To solve the above problem, various improved golf practice devices have been developed. For example, an improved golf practice device employs a hydraulic measure to push the teeing ground of the golf practice device. Multiple hydraulic members are used to drive the teeing ground into a desired tilted state to simulate the landform of a real golf course. However, such golf practice device requires an entire set of hydraulic equipment and electronic control system so that the cost for the golf practice device is very high. Moreover, once the golf practice device is installed, it is impossible to freely remove the golf practice device to another site.

SUMMARY OF THE INVENTION

It is therefore a primary object of the present invention to provide a tiltable/adjustable golf practice device, in which the teeing ground can be adjusted to a tilted state to simulate the landform of a real golf course in accordance with the requirement of a user in practice.

To achieve the above and other objects, the tiltable/adjustable golf practice device of the present invention includes: a base seat having a front side, a back side, a left side and a right side; a first tilting adjustment unit mounted on the base seat, the first tilting adjustment unit including multiple height adjusters and a first adjustment rod, wherein at least one height adjuster is mounted on the front side of the base seat and at least one height adjuster is mounted on the back side of the base seat, the first adjustment rod being mounted on the base seat, when the first adjustment rod is positioned in a first position, the first adjustment rod being drivingly connected with the height adjusters of the first tilting adjustment unit on the front side of the base seat to lift or lower the height adjusters, when the first adjustment rod is positioned in a second position, the first adjustment rod being drivingly connected with the height adjusters of the first tilting adjustment unit on the back side of the base seat to lift or lower the height adjusters; a second tilting adjustment unit mounted on the base seat, the second tilting adjustment unit including multiple height adjusters and a second adjustment rod, wherein at least one height adjuster is mounted on the left side of the base seat and at least one height adjuster is mounted on the right side of the base seat, the second adjustment rod being mounted on the base seat, when the second adjustment rod is positioned in a first position, the second adjustment rod being drivingly connected with the height adjusters of the second tilting adjustment unit on the left side of the base seat to lift or lower the height adjusters, when the second adjustment rod is positioned in a second position, the second adjustment rod being drivingly connected with the height adjusters of the second tilting adjustment unit on the right side of the base seat to lift or lower the height adjusters; and a teeing ground rested on and bridged between the height adjusters of the first and second tilting adjustment units. An artificial lawn can be paved on the teeing ground. According to the above arrangement, via the first and second adjustment rods, a user can control and lift or lower the height adjusters on the front side, back side, left side and right side of the base seat so as to tilt the teeing ground to simulate the landform of a real golf course for a user to practice teeing skill.

In the above tiltable/adjustable golf practice device, two sets of height adjusters of the first tilting adjustment unit are respectively mounted on two corners of the front side of the base seat and two corners of the back side of the base seat. Each of the height adjusters has a threaded rod rotatably mounted in pivot seats fixed on the base seat. One end of the threaded rod is connected with a driven gear. Two slide blocks are screwed on the threaded rod. The slide blocks are synchronously axially movable along the threaded rod toward each other. The height adjuster further has a seat body. Two side of the seat body are respectively pivotally connected to the slide blocks via links. The seat body serves to support the teeing ground.

In the above tiltable/adjustable golf practice device, the first adjustment rod is slidably rotatably mounted in a first pivot seat of the base seat. A front driving gear and a rear driving gear are disposed on the first adjustment rod. When the first adjustment rod is slid to the first position, the front driving gear is directly engaged with the driven gear of the height adjusters of the first tilting adjustment unit on the front side of the base seat or indirectly engaged with the driven gear via a middle gear, whereby a user can rotate the first adjustment rod to synchronously drive and lift or lower the height adjusters. When the first adjustment rod is slid to the second position, the rear driving gear is directly engaged with the driven gear of the height adjusters of the first tilting adjustment unit on the back side of the base seat or indirectly engaged with the driven gear via a middle gear, whereby a user can rotate the first adjustment rod to synchronously drive and lift or lower the height adjusters.

In the above tiltable/adjustable golf practice device, the first pivot seat in which the first adjustment rod is rotatably mounted has a latch section. The first adjustment rod is annularly formed a first latch groove and a second latch groove. When the first adjustment rod is positioned in the first position, the latch section of the first pivot seat is latched in the first latch groove of the first adjustment rod. When the first adjustment rod is positioned in the second position, the latch section of the first pivot seat is latched in the second latch groove of the first adjustment rod.

In the above tiltable/adjustable golf practice device, two sets of height adjusters of the second tilting adjustment unit are respectively mounted on two corners of the left side of the base seat and two corners of the right side of the base seat. Each of the height adjusters has a threaded rod rotatably mounted in pivot seats fixed on the base seat. One end of the threaded rod is connected with a driven gear. Two slide blocks are screwed on the threaded rod. The slide blocks are synchronously axially movable along the threaded rod toward each other. The height adjuster further has a seat body. Two side of the seat body are respectively pivotally connected to the slide blocks via links. The seat body serves to support the teeing ground.

In the above tiltable/adjustable golf practice device, the second adjustment rod is slidably rotatably mounted in a second pivot seat of the base seat. A left driving gear and a right driving gear are disposed on the second adjustment rod. When the second adjustment rod is slid to the first position, the left driving gear is directly engaged with the driven gear of the height adjusters of the second tilting adjustment unit on the left side of the base seat or indirectly engaged with the driven gear via a middle gear, whereby a user can rotate the second adjustment rod to synchronously drive and lift or lower the height adjusters on the left side. When the second adjustment rod is slid to the second position, the right driving gear is directly engaged with the driven gear of the height adjusters of the second tilting adjustment unit on the right side of the base seat or indirectly engaged with the driven gear via a middle gear, whereby a user can rotate the second adjustment rod to synchronously drive and lift or lower the height adjusters on the right side.

In the above tiltable/adjustable golf practice device, the second pivot seat in which the second adjustment rod is rotatably mounted has a latch section. The second adjustment rod is annularly formed a first latch groove and a second latch groove. When the second adjustment rod is positioned in the first position, the latch section of the second pivot seat is latched in the first latch groove of the second adjustment rod. When the second adjustment rod is positioned in the second position, the latch section of the second pivot seat is latched in the second latch groove of the second adjustment rod.

In use of the tiltable/adjustable golf practice device of the present invention, the height adjusters on any of the front side, back side, left side and right side can be lifted to drivingly lift the teeing ground into a laterally tilted state. Alternatively, the height adjusters on any two of the front side, back side, left side and right side can be lifted to tilt the teeing ground toward a corner so as to simulate the landform of a real golf course. Accordingly, a user can practice the teeing skill with respect to different inclined landforms.

The tiltable/adjustable golf practice device further includes a tee holder unit fixedly disposed under the bottom face of the teeing ground. The tee holder unit includes a fixing seat locked under the bottom of the teeing ground and a tee holder fitted in the fixing seat and extending through the teeing ground. A bottom end of the tee holder is coupled with a threaded rod. The threaded rod is screwed in a driven gear, which is drivable by a driving gear. The driving gear is drivingly rotatable by a rod body rotatably mounted on the fixing seat, whereby a user can adjust the tee holder to a desired teeing height. The tee holder is made of a soft material such as rubber, silicone, polyurethane and spring to avoid breakage when struck by a golf club. The top end of the tee holder is formed with a socket in which a tee can be inserted for a user to stably place a golf ball on the tee.

By means of lifting or lowering the respective sets of height adjusters disposed on the corners, the teeing ground can be tilted forward, backward, leftward or rightward or tilted toward any corner to simulate the landform of a real golf course in accordance with the requirement of a user in practice. Moreover, the present invention is free from any electronic control or hydraulic device so that the manufacturing cost of the present invention is greatly lowered. Also, a user can freely remove the present invention to another site. Therefore, the application of the present invention is facilitated.

The present invention can be best understood through the following description and accompanying drawings, wherein:

DETAILED DESCRIPTION OF THE PREFERRED EMBODIMENTS

Figure 1:
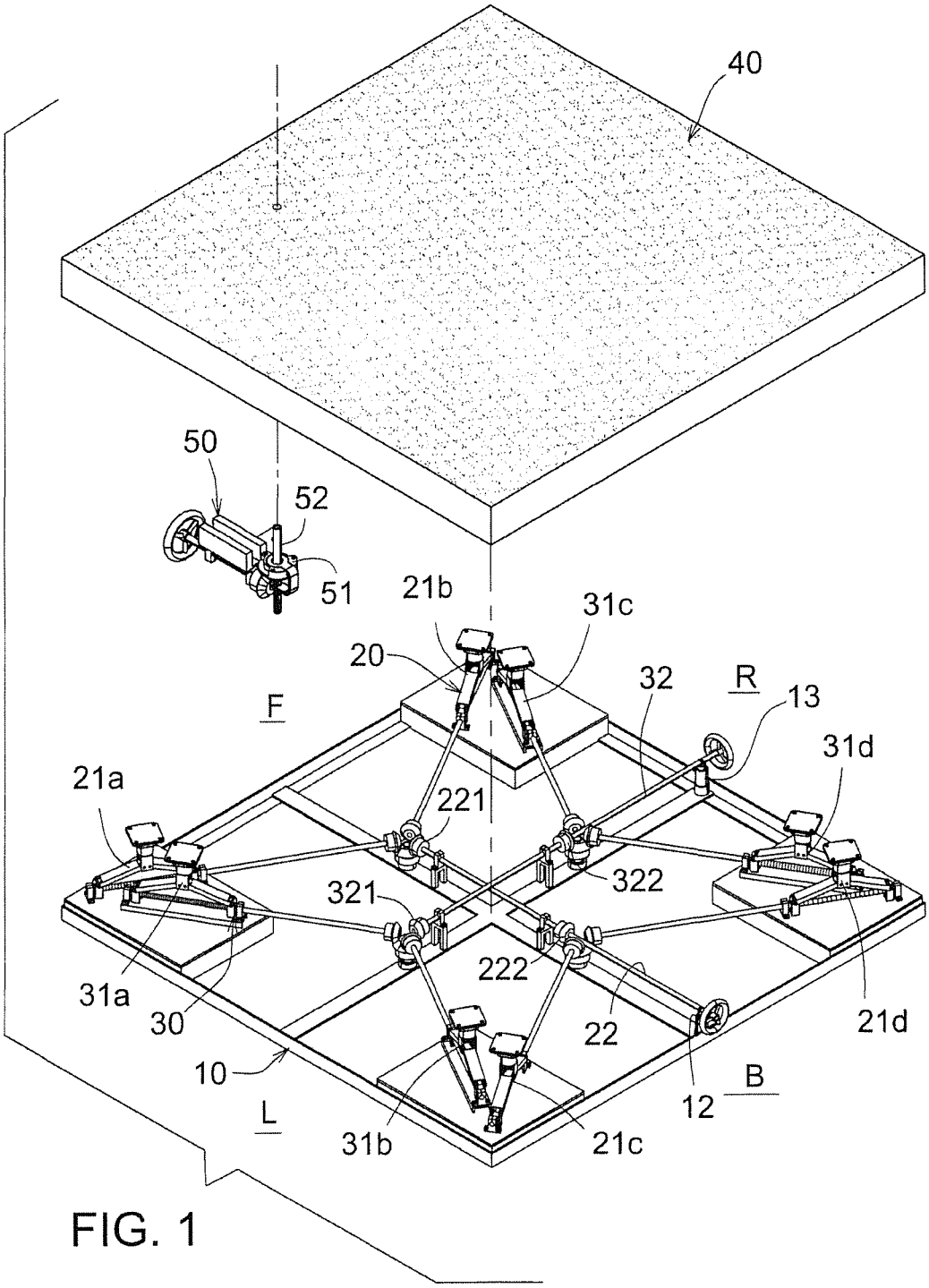
FIG. 1 is a perspective exploded view of the present invention.

Please refer to FIGS. 1 to 8. The tiltable/adjustable golf practice device of the present invention has a teeing ground 40. As necessary, the teeing ground 40 can be adjusted into a tilted state to simulate the landform of a real golf course.

Please refer to FIGS. 1, 2, 3 and 4. The tiltable/adjustable golf practice device of the present invention includes a base seat 10 having a front side F, a back side B, a left side L and a right side R. The tiltable/adjustable golf practice device of the present invention further includes a first tilting adjustment unit 20 mounted on the base seat 10. The first tilting adjustment unit 20 includes multiple height adjusters 21*a*, 21*b*, 21*c*, 21*d* and a first adjustment rod 22, wherein at least one height adjuster 21*a*, 21*b* is mounted on the front side F of the base seat 10 and at least one height adjuster 21*c*, 21*d* is mounted on the back side B of the base seat 10. The first adjustment rod 22 is mounted on the base seat 10. When the first adjustment rod 22 is positioned in a first position, the first adjustment rod 22 is drivingly connected with the height adjusters 21*a*, 21*b* on the front side F of the base seat 10 to lift or lower the height adjusters 21*a*, 21*b*. When the first adjustment rod 22 is positioned in a second position, the first adjustment rod 22 is drivingly connected with the height adjusters 21*c*, 21*d* on the back side B of the base seat 10 to lift or lower the height adjusters 21*c*, 21*d*. The tiltable/adjustable golf practice device of the present invention further includes a second tilting adjustment unit 30 mounted on the base seat 10. The second tilting adjustment unit 30 includes multiple height adjusters 31*a*, 31*b*, 31*c*, 31*d* and a second adjustment rod 32, wherein at least one height adjuster 31*a*, 31*b* is mounted on the left side L of the base seat 10 and at least one height adjuster 31*c*, 31*d* is mounted on the right side R of the base seat 10. The second adjustment rod 32 is mounted on the base seat 10. When the second adjustment rod 32 is positioned in a first position, the second adjustment rod 32 is drivingly connected with the height adjusters 31*a*, 31*b* on the left side L of the base seat 10 to lift or lower the height adjusters 31*a*, 31*b*. When the second adjustment rod 32 is positioned in a second position, the second adjustment rod 32 is drivingly connected with the height adjusters 31*c*, 31*d* on the right side R of the base seat 10 to lift or lower the height adjusters 31*c*, 31*d*. tiltable/adjustable golf practice device of the present invention further includes a teeing ground 40 rested on and bridged between the height adjusters 21*a*, 21*b*, 21*c*, 21*d*, 31*a*, 31*b*, 31*c*, 31*d* of the first and second tilting adjustment units 20, 30. An artificial lawn can be paved on the teeing ground 40. According to the above arrangement, via the first and second adjustment rods 22, 32, a user can control and lift or lower the height adjusters 21*a*, 21*b*, 21*c*, 21*d*, 31*a*, 31*b*, 31*c*, 31*d* on the front side F, back side B, left side L and right side R of the base seat 10 so as to tilt the teeing ground 40 to simulate the landform of a real golf course for a user to practice teeing skill.

In the tiltable/adjustable golf practice device of the present invention, the two sets of height adjusters 21*a*, 21*b* and 21*c*, 21*d* of the first tilting adjustment unit 20 are respectively mounted on two corners of the front side F of the base seat 10 and two corners of the back side B of the base seat 10.

Figure 3:
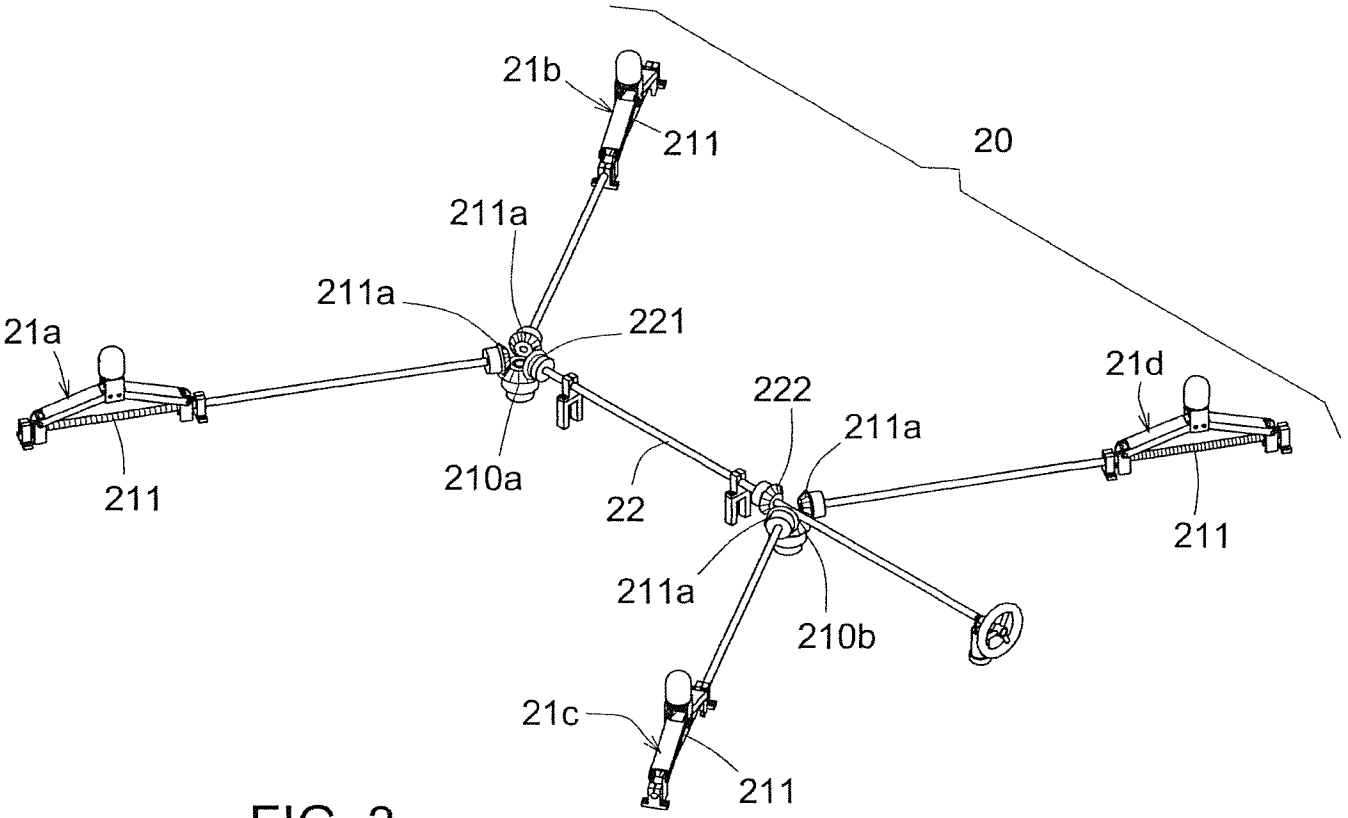
FIG. 3 is a perspective view of the first tilting adjustment unit of the present invention.
Figure 7:
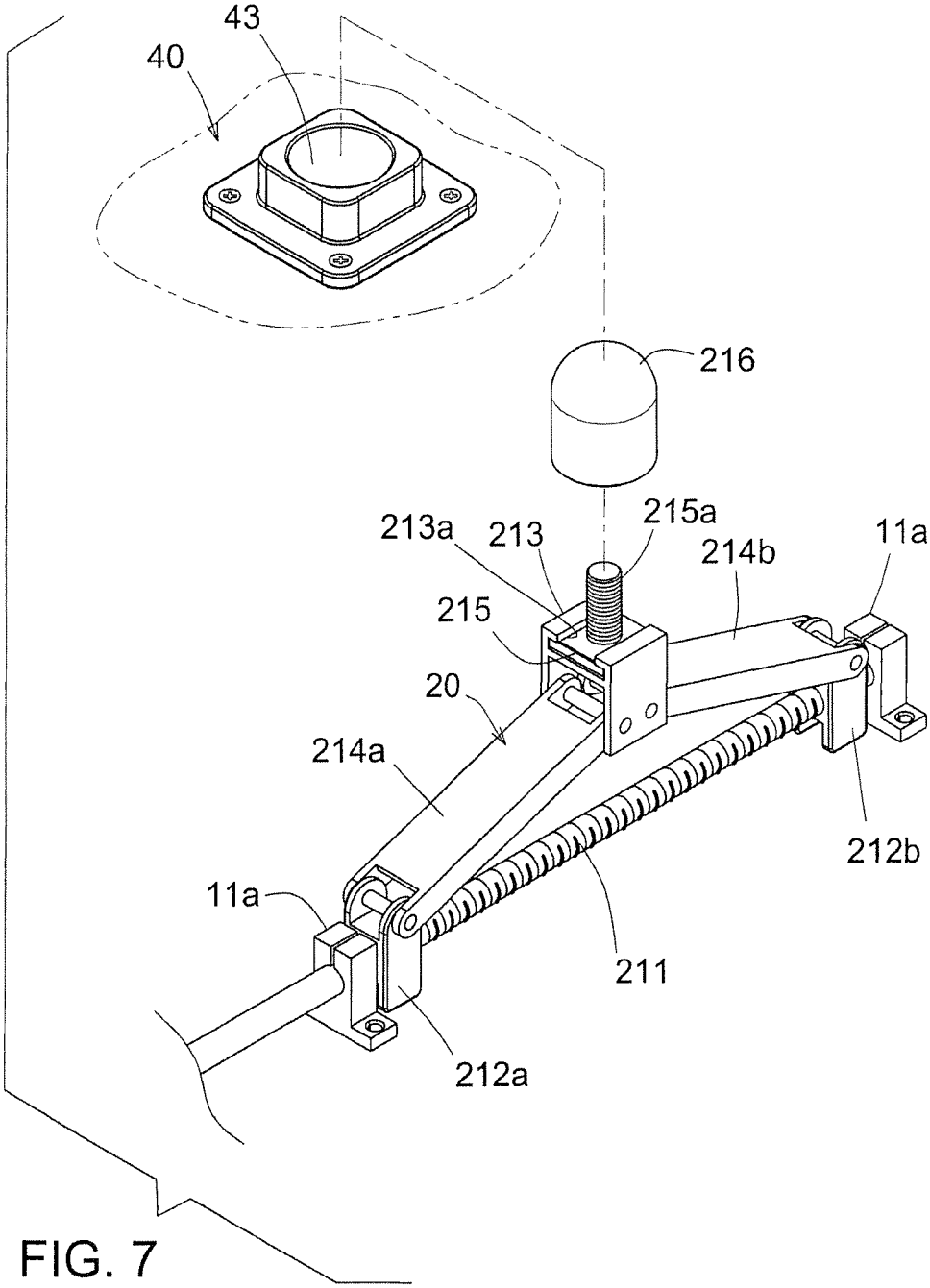
FIG. 7 is a perspective view of the height adjuster of the first tilting adjustment unit of the present invention.

As shown in FIGS. 3 and 7, each of the height adjusters 21*a*, 21*b*, 21*c*, 21*d* has a threaded rod 211 rotatably mounted in pivot seats 11*a*, 11*b*, 11*c*, 11*d* fixed on the base seat 10. One end of the threaded rod 211 is connected with a driven gear 211*a*. Two slide blocks 212*a*, 212*b* are screwed on the threaded rod 211. The slide blocks 212*a*, 212*b* are synchronously axially movable along the threaded rod 211 toward each other. The height adjuster further has a seat body 213. Two side of the seat body 213 are respectively pivotally connected to the slide blocks 212*a*, 212*b* on the corresponding sides via links 214*a*, 214*b*. The seat body 213 serves to support the teeing ground 40.

As shown in FIG. 7, the seat body 213 is formed with an insertion slot 213*a*. A connection member 215 is inserted in the insertion slot 213*a*. A threaded rod 215*a* upward protrudes from the connection member 215 for locking with a support head 216. The support head 216 has a domed top end correspondingly fitted in a dent 43 under the bottom of the teeing ground 40 for supporting the same.

Figure 2:
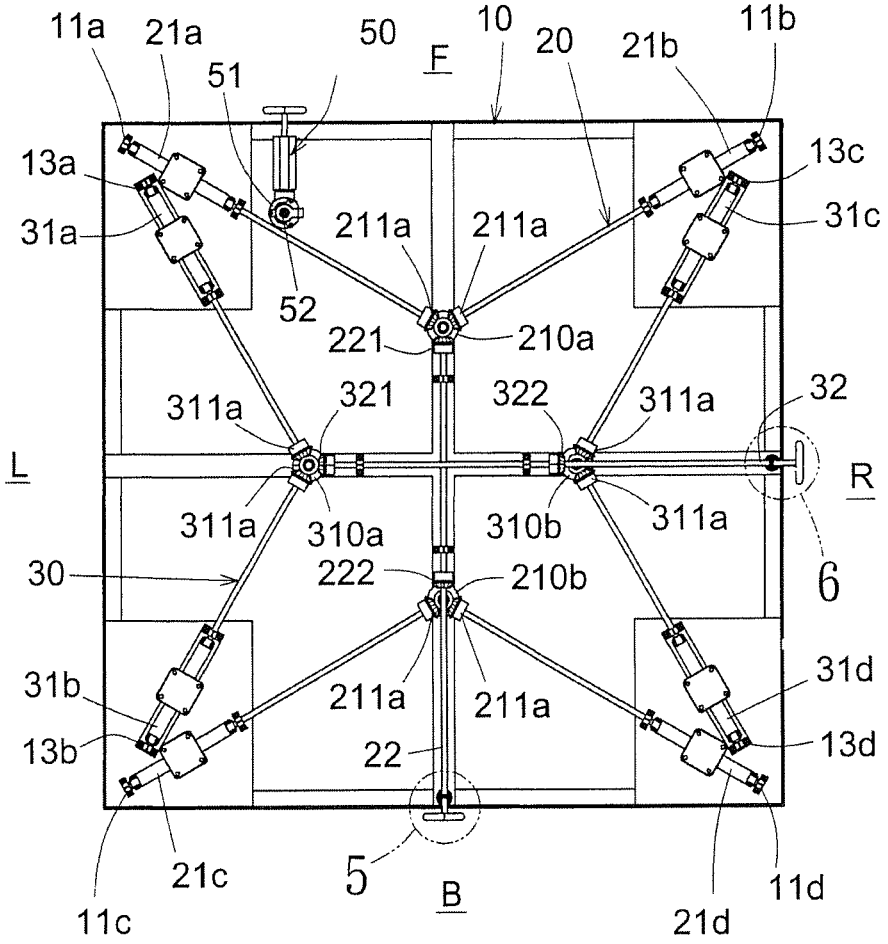
FIG. 2 is a top view of the present invention with the teeing ground removed.
Figure 5:
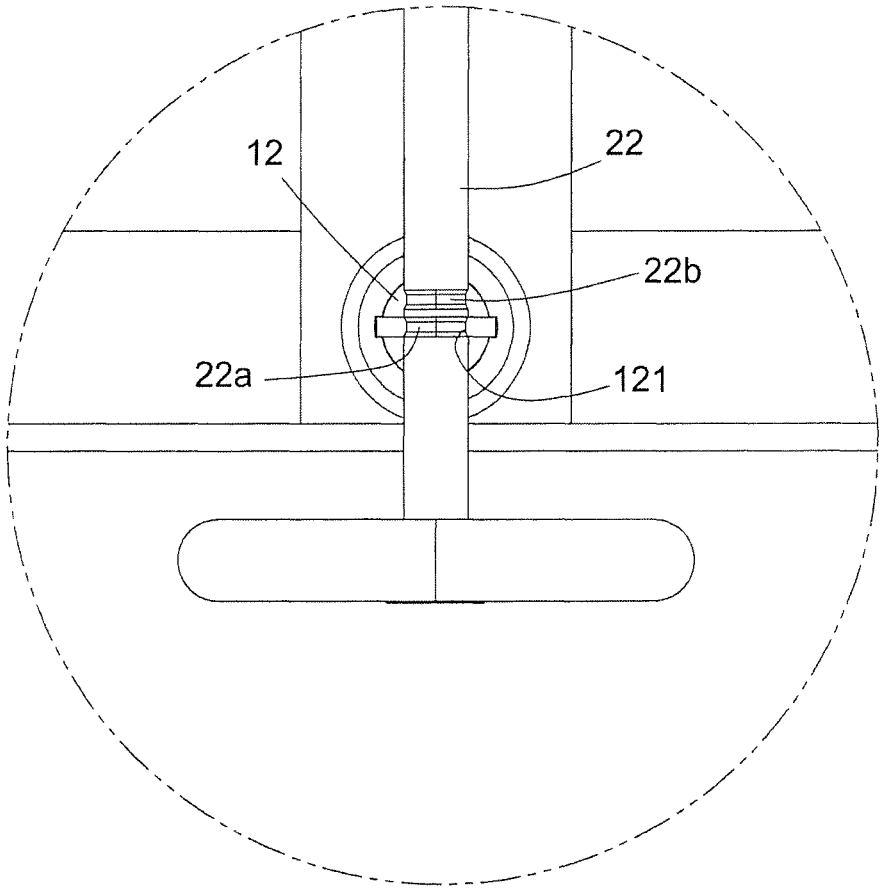
FIG. 5 is an enlarged view of circled area 5 of FIG. 2.

Referring to FIGS. 2, 3 and 5, in the tiltable/adjustable golf practice device of the present invention, the first adjustment rod 22 is slidably rotatably mounted in a first pivot seat 12 of the base seat 10. A front driving gear 221 and a rear driving gear 222 are disposed on the first adjustment rod 22. When the first adjustment rod 22 is slid to the first position, the front driving gear 221 is directly drivingly engaged with the driven gear 211*a* of the height adjusters 21*a*, 21*b* of the first tilting adjustment unit 20 on the front side F of the base seat 10 or indirectly drivingly engaged with the driven gear 211*a* via a middle gear 210*a*. Accordingly, a user can rotate the first adjustment rod 22 to synchronously drive and lift or lower the height adjusters 21*a*, 21*b*. On the other hand, when the first adjustment rod 22 is slid to the second position, the rear driving gear 222 is directly drivingly engaged with the driven gear 211*a* of the height adjusters 21*c*, 21*d* of the first tilting adjustment unit 20 on the back side B of the base seat 10 or indirectly drivingly engaged with the driven gear 211*a* via a middle gear 210*b*. Accordingly, a user can rotate the first adjustment rod 22 to synchronously drive and lift or lower the height adjusters 21*c*, 21*d*.

Referring to FIGS. 2, 3 and 5, the first pivot seat 12 in which the first adjustment rod 22 is rotatably mounted has a latch section 121. The first adjustment rod 22 is annularly formed a first latch groove 22*a* and a second latch groove 22*b*. When the first adjustment rod 22 is positioned in the first position, the latch section 121 of the first pivot seat 12 is latched in the first latch groove 22*a* of the first adjustment rod 22. When the first adjustment rod 22 is positioned in the second position, the latch section 121 of the first pivot seat 12 is latched in the second latch groove 22*b* of the first adjustment rod 22.

Figure 4:
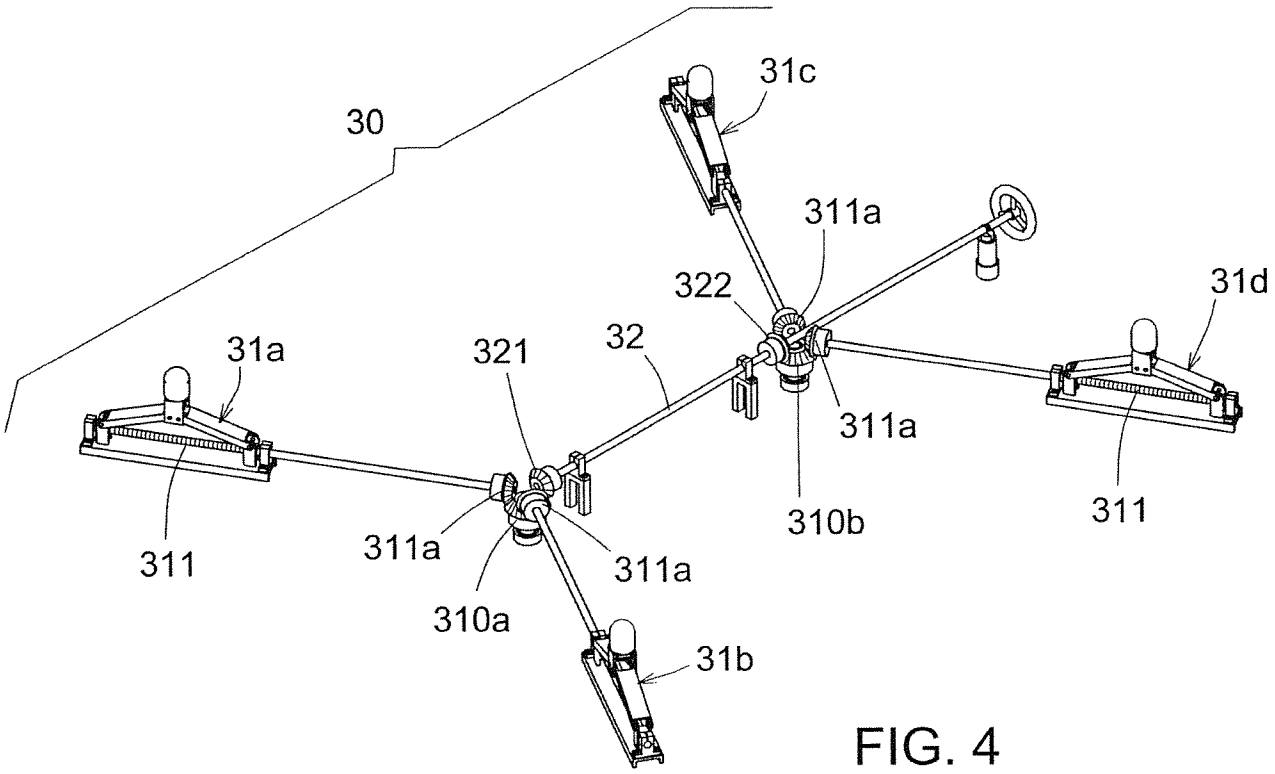
FIG. 4 is a perspective view of the second tilting adjustment unit of the present invention.

As shown in FIGS. 1, 2 and 4, in the tiltable/adjustable golf practice device of the present invention, the two sets of height adjusters 31*a*, 31*b* and 31*c*, 31*d* of the second tilting adjustment unit 30 are respectively mounted on two corners of the left side L of the base seat 10 and two corners of the right side R of the base seat 10.

Figure 8:
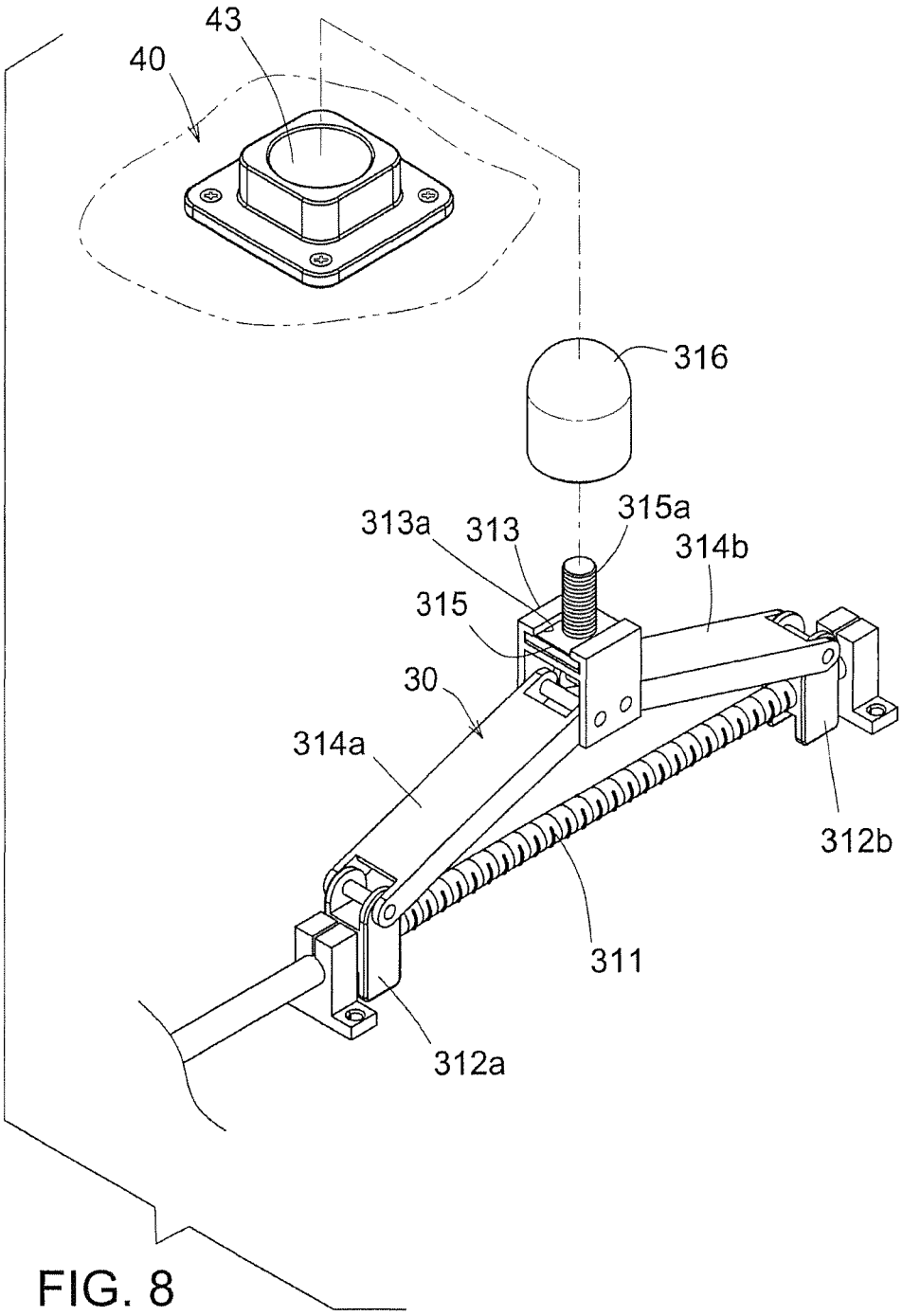
FIG. 8 is a perspective view of the height adjuster of the second tilting adjustment unit of the present invention.

As shown in FIGS. 2, 3 and 8, each of the height adjusters 31*a*, 31*b*, 31*c*, 31*d* has a threaded rod 311 rotatably mounted in pivot seats 13*a*, 13*b*, 13*c*, 13*d* fixed on the base seat 10. One end of the threaded rod 311 is connected with a driven gear 311*a*. Two slide blocks 312*a*, 312*b* are screwed on the threaded rod 311. The slide blocks 312*a*, 312*b* are synchronously axially movable along the threaded rod 311 toward each other. The height adjuster further has a seat body 313. Two side of the seat body 313 are respectively pivotally connected to the slide blocks 312*a*, 312*b* on the corresponding sides via links 314*a*, 314*b*. The seat body 313 serves to support the teeing ground 40.

The seat body 313 is formed with an insertion slot 313*a*. A connection member 315 is inserted in the insertion slot 313*a*. A threaded rod 315*a* upward protrudes from the connection member 315 for locking with a support head 316. The support head 316 has a domed top end correspondingly fitted in a dent 43 under the bottom of the teeing ground 40 for supporting the same.

Figure 6:
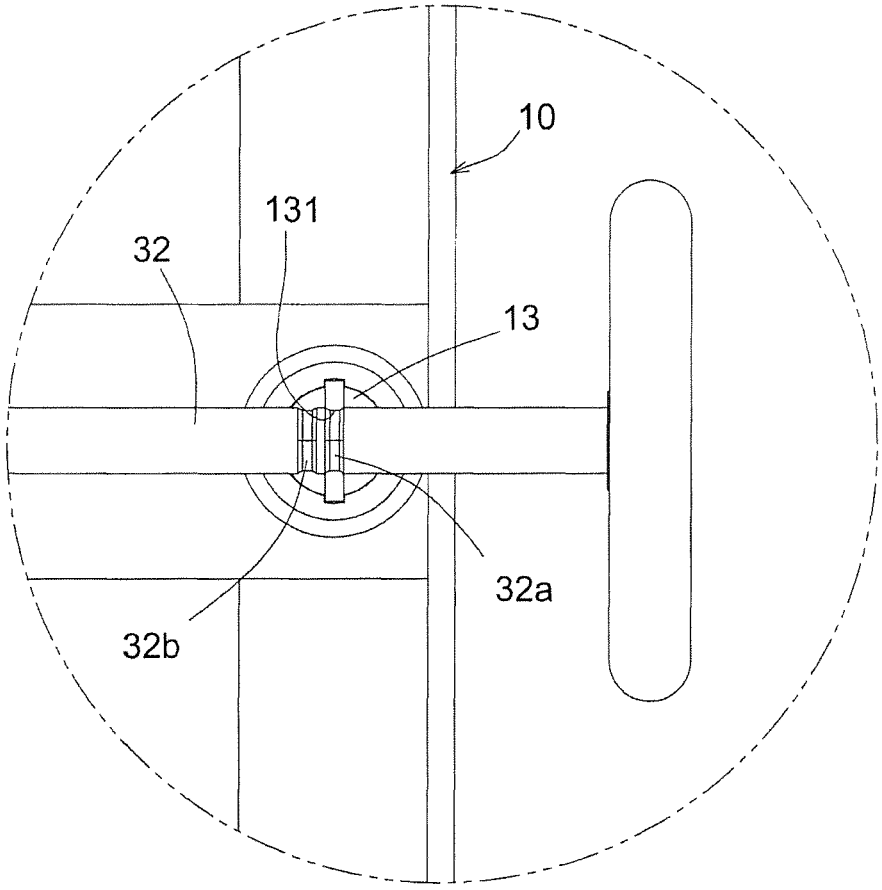
FIG. 6 is an enlarged view of circled area 6 of FIG. 2.

Referring to FIGS. 2, 3 and 6, in the tiltable/adjustable golf practice device of the present invention, the second adjustment rod 32 is slidably rotatably mounted in a second pivot seat 13 of the base seat 10. A left driving gear 321 and a right driving gear 322 are disposed on the second adjustment rod 32. When the second adjustment rod 32 is slid to the first position, the left driving gear 321 is directly drivingly engaged with the driven gear 311*a* of the height adjusters 31*a*, 31*b* of the second tilting adjustment unit 30 on the left side L of the base seat 10 or indirectly drivingly engaged with the driven gear 311*a* via a middle gear 310*a*. Accordingly, a user can rotate the second adjustment rod 32 to synchronously drive and lift or lower the height adjusters 31*a*, 31*b*. On the other hand, when the second adjustment rod 32 is slid to the second position, the right driving gear 322 is directly drivingly engaged with the driven gear 311*a* of the height adjusters 31*c*, 31*d* of the second tilting adjustment unit 20 on the right side R of the base seat 10 or indirectly drivingly engaged with the driven gear 311*a* via a middle gear 310*b*. Accordingly, a user can rotate the second adjustment rod 32 to synchronously drive and lift or lower the height adjusters 31*c*, 31*d*.

The second pivot seat 13 in which the second adjustment rod 32 is rotatably mounted has a latch section 131. The second adjustment rod 32 is annularly formed a first latch groove 32*a* and a second latch groove 32*b*. When the second adjustment rod 32 is positioned in the first position, the latch section 131 of the second pivot seat 13 is latched in the first latch groove 32*a* of the second adjustment rod 32. When the second adjustment rod 32 is positioned in the second position, the latch section 131 of the second pivot seat 13 is latched in the second latch groove 32*b* of the second adjustment rod 32.

Figure 9:
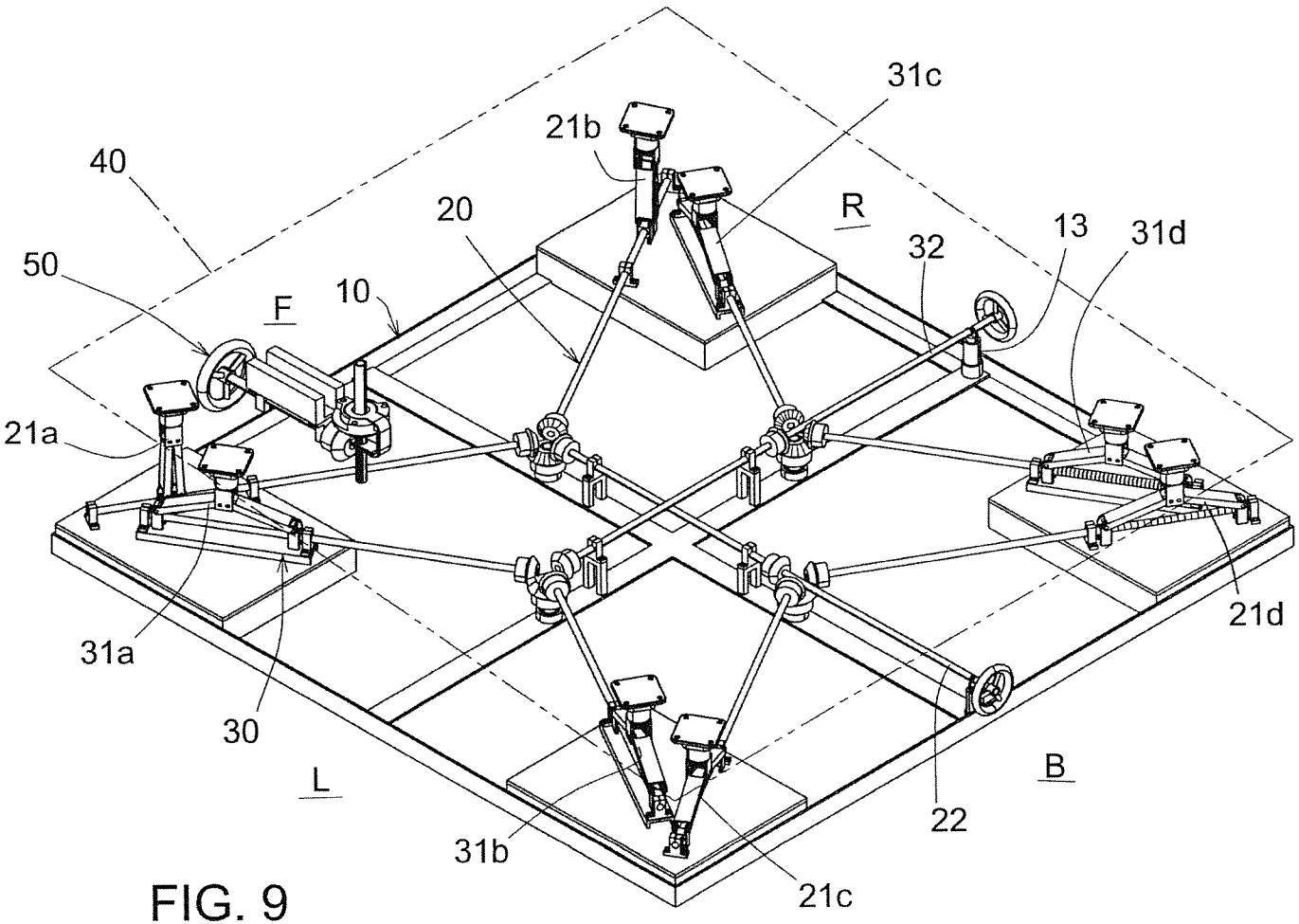
FIG. 9 is a perspective view according to FIG. 1, showing that the height adjusters of the first tilting adjustment unit on the front side of the teeing ground are lifted to tilt the teeing ground.
Figure 10:
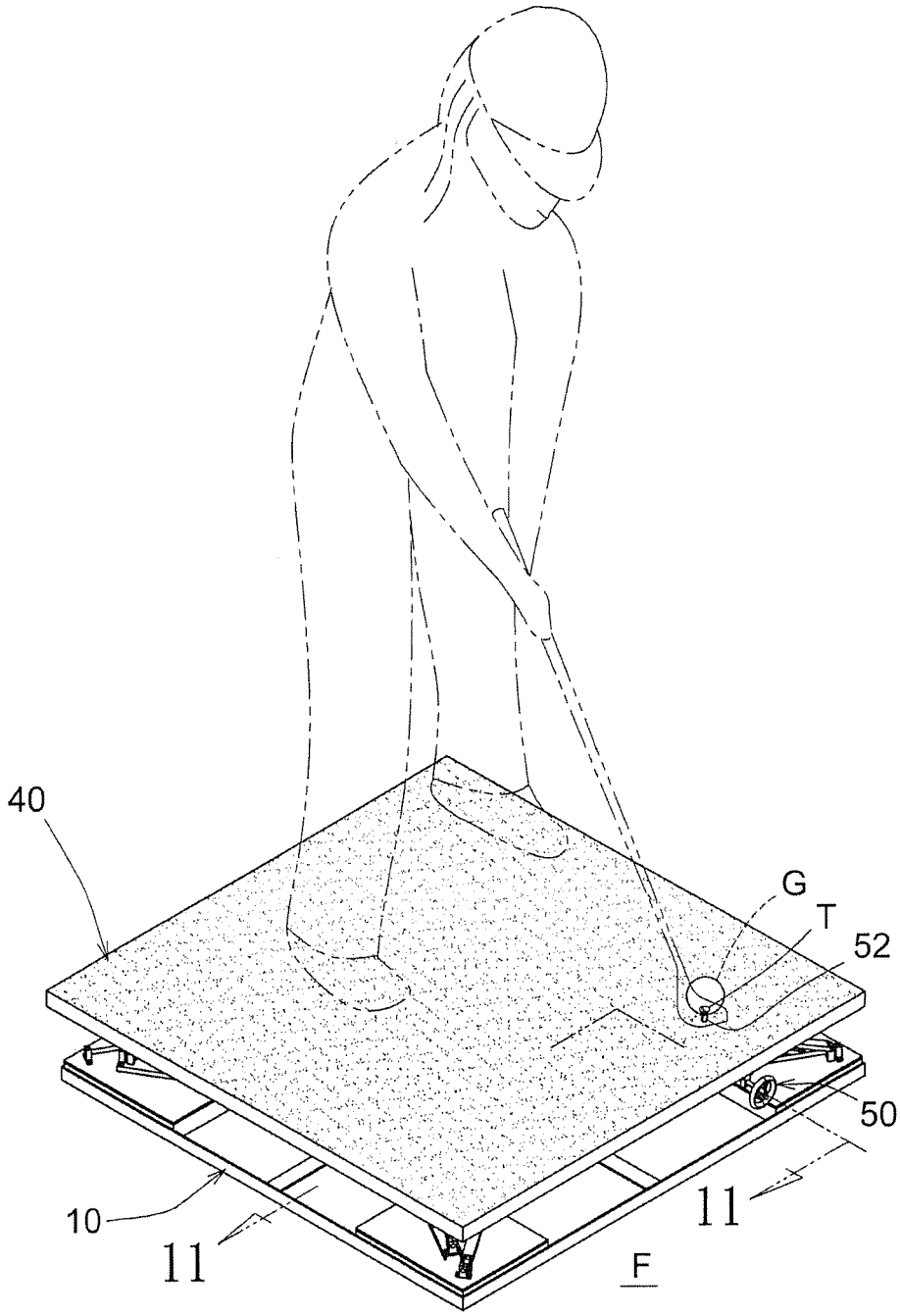
FIG. 10 shows that a user stands on the tilted teeing ground according to FIG. 9 to practice the teeing skill.

As shown in FIGS. 9 and 10, in use of the tiltable/adjustable golf practice device of the present invention, the height adjusters 21*a*, 21*b* or 21*c*, 21*d* or 31*a*, 31*b* or 31*c*, 31*d* on any of the front side, back side, left side and right side can be lifted to drivingly lift the teeing ground 40 into a laterally tilted state. Alternatively, the height adjusters 21*a*, 21*b* or 21*c*, 21*d* or 31*a*, 31*b* or 31*c*, 31*d* on any two of the front side, back side, left side and right side can be lifted to tilt the teeing ground 40 toward a corner so as to simulate the landform of a real golf course. Accordingly, a user can stand on the tilted teeing ground 40 to tee off the golf ball and practice the teeing skill with respect to different inclined landforms.

Figure 11:
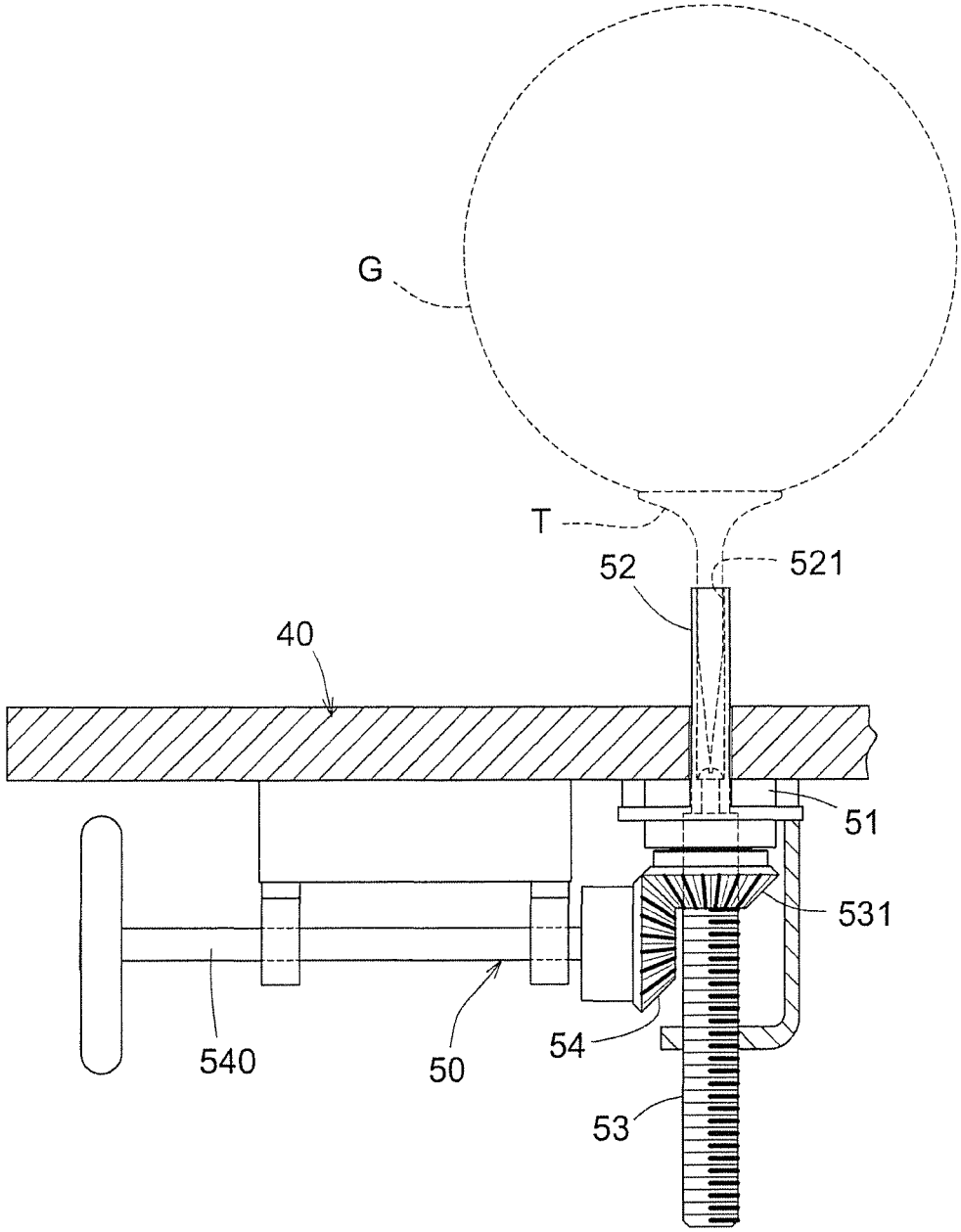
FIG. 11 is a sectional view taken along line 11-11 of FIG. 10, showing the structure of the tee holder unit of the present invention.

As shown in FIGS. 1 and 11, the tiltable/adjustable golf practice device of the present invention further includes a tee holder unit 50 fixedly disposed under the bottom face of the teeing ground 40. The tee holder unit 50 includes a fixing seat 51 locked under the bottom of the teeing ground 40 and a tee holder 52 fitted in the fixing seat 51 and extending through the teeing ground 40. A bottom end of the tee holder 52 is coupled with a threaded rod 53. The threaded rod 53 is screwed in a driven gear 531, which is drivable by a driving gear 54. The driving gear 54 is drivingly rotatable by a rod body 540, whereby a user can adjust the tee holder 52 to a desired teeing height. The tee holder 52 is made of a soft material such as rubber, silicone, polyurethane and spring to avoid breakage when struck by a golf club.

Please refer to FIGS. 10 and 11. The top end of the tee holder 52 is formed with a socket 521 in which a tee T can be inserted for a user to stably place a golf ball G on the tee T.

According to the above arrangement, by means of lifting or lowering the respective sets of height adjusters 21*a*, 21*b*, 21*c*, 21*d*, 31*a*, 31*b*, 31*c*, 31*d* disposed on the corners, the teeing ground can be tilted forward, backward, leftward or rightward or tilted toward any corner to simulate the landform of a real golf course in accordance with the requirement of a user in practice. Moreover, the present invention is free from any electronic control or hydraulic device so that the manufacturing cost of the present invention is greatly lowered. Also, a user can freely remove the present invention to another site. Therefore, the application of the present invention is facilitated.

The above embodiments are only used to illustrate the present invention, not intended to limit the scope thereof. Many modifications of the above embodiments can be made without departing from the spirit of the present invention.

What is claimed is:

1. A tiltable/adjustable golf practice device comprising:

(a) a base seat having a front side, a back side, a left side and a right side;

(b) a first tilting adjustment unit mounted on the base seat, the first tilting adjustment unit including multiple height adjusters and a first adjustment rod, wherein at least one height adjuster is mounted on the front side of the base seat and at least one height adjuster is mounted on the back side of the base seat, the first adjustment rod being mounted on the base seat, when the first adjustment rod is positioned in a first position, the first adjustment rod being drivingly connected with the height adjusters of the first tilting adjustment unit on the front side of the base seat to lift or lower the height adjusters, when the first adjustment rod is positioned in a second position, the first adjustment rod being drivingly connected with the height adjusters of the first tilting adjustment unit on the back side of the base seat to lift or lower the height adjusters, two sets of height adjusters of the first tilting adjustment unit being respectively mounted on two corners of the front side of the base seat and two corners of the back side of the base seat, each of the height adjusters having a threaded rod rotatably mounted in pivot seats fixed on the base seat, one end of the threaded rod being connected with a driven gear, two slide blocks being screwed on the threaded rod, the slide blocks being synchronously axially movable along the threaded rod toward each other, the height adjuster further having a seat body, two sides of the seat body being respectively pivotally connected to the slide blocks on the corresponding sides via links, the seat body serving to support the teeing ground;

(c) a second tilting adjustment unit mounted on the base seat, the second tilting adjustment unit including multiple height adjusters and a second adjustment rod, wherein at least one height adjuster is mounted on the left side of the base seat and at least one height adjuster is mounted on the right side of the base seat, the second adjustment rod being mounted on the base seat, when the second adjustment rod is positioned in a first position, the second adjustment rod being drivingly connected with the height adjusters of the second tilting adjustment unit on the left side of the base seat to lift or lower the height adjusters, when the second adjustment rod is positioned in a second position, the second adjustment rod being drivingly connected with the height adjusters of the second tilting adjustment unit on the right side of the base seat to lift or lower the height adjusters; and (d) a teeing ground rested on and bridged between the height adjusters of the first and second tilting adjustment units.

2. The tiltable/adjustable golf practice device as claimed in claim 1, wherein the seat body is formed with an insertion slot, a connection member being inserted in the insertion slot, a threaded rod upward protruding from the connection member for locking with a support head, the support head having a domed top end correspondingly fitted in a dent under a bottom of the teeing ground for supporting the teeing ground.

3. The tiltable/adjustable golf practice device as claimed in claim 1, wherein the first adjustment rod is slidably rotatably mounted in a first pivot seat of the base seat, a front driving gear and a rear driving gear being disposed on the first adjustment rod, when the first adjustment rod is slid to the first position, the front driving gear is directly or indirectly engaged with the driven gear of the height adjusters of the first tilting adjustment unit on the front side of the base seat, when the first adjustment rod is slid to the second position, the rear driving gear is directly or indirectly engaged with the driven gear of the height adjusters of the first tilting adjustment unit on the back side of the base seat.

4. The tiltable/adjustable golf practice device as claimed in claim 3, wherein the first pivot seat in which the first adjustment rod is rotatably mounted has a latch section, the first adjustment rod being annularly formed a first latch groove and a second latch groove, when the first adjustment rod is positioned in the first position, the latch section of the first pivot seat being latched in the first latch groove of the first adjustment rod, when the first adjustment rod is positioned in the second position, the latch section of the first pivot seat being latched in the second latch groove of the first adjustment rod.

5. The tiltable/adjustable golf practice device as claimed in claim 1, wherein two sets of height adjusters of the second tilting adjustment unit are respectively mounted on two corners of the left side of the base seat and two corners of the right side of the base seat, each of the height adjusters having a threaded rod rotatably mounted in pivot seats fixed on the base seat, one end of the threaded rod being connected with a driven gear, two slide blocks being screwed on the threaded rod, the slide blocks being synchronously axially movable along the threaded rod toward each other, the height adjuster further having a seat body, two side of the seat body being respectively pivotally connected to the slide blocks on the corresponding sides via links, the seat body serving to support the teeing ground.

6. The tiltable/adjustable golf practice device as claimed in claim 5, wherein the seat body is formed with an insertion slot, a connection member being inserted in the insertion slot, a threaded rod upward protruding from the connection member for locking with a support head, the support head having a domed top end correspondingly fitted in a dent under a bottom of the teeing ground for supporting the teeing ground.

7. The tiltable/adjustable golf practice device as claimed in claim 5, wherein the second adjustment rod is slidably rotatably mounted in a second pivot seat of the base seat, a left driving gear and a right driving gear being disposed on the second adjustment rod, when the second adjustment rod is slid to the first position, the left driving gear is directly or indirectly engaged with the driven gear of the height adjusters of the second tilting adjustment unit on the left side of the base seat, when the second adjustment rod is slid to the second position, the right driving gear is directly or indirectly engaged with the driven gear of the height adjusters of the second tilting adjustment unit on the right side of the base seat.

8. The tiltable/adjustable golf practice device as claimed in claim 7, wherein the second pivot seat has a latch section, the second adjustment rod being annularly formed a first latch groove and a second latch groove, when the second adjustment rod is positioned in the first position, the latch section of the second pivot seat being latched in the first latch groove of the second adjustment rod, when the second adjustment rod is positioned in the second position, the latch section of the second pivot seat being latched in the second latch groove of the second adjustment rod.

9. The tiltable/adjustable golf practice device as claimed in claim 1, further comprising a tee holder unit fixedly disposed under the bottom face of the teeing ground, the tee holder unit including a fixing seat locked under the bottom of the teeing ground and a tee holder fitted in the fixing seat and extending through the teeing ground, a bottom end of the tee holder being coupled with a threaded rod, the threaded rod being screwed in a driven gear, which is drivable by a driving gear, the driving gear being drivingly rotatable by a rod body whereby a user can adjust the tee holder to a desired teeing height, a top end of the tee holder being formed with a socket in which a tee can be inserted.

10. A tiltable/adjustable golf practice device comprising:

(a) a base seat having a front side, a back side, a left side and a right side;

(b) a first tilting adjustment unit mounted on the base seat, the first tilting adjustment unit including multiple height adjusters and a first adjustment rod, wherein at least one height adjuster is mounted on the front side of the base seat and at least one height adjuster is mounted on the back side of the base seat, the first adjustment rod being mounted on the base seat, when the first adjustment rod is positioned in a first position, the first adjustment rod being drivingly connected with the height adjusters of the first tilting adjustment unit on the front side of the base seat to lift or lower the height adjusters, when the first adjustment rod is positioned in a second position, the first adjustment rod being drivingly connected with the height adjusters of the first tilting adjustment unit on the back side of the base seat to lift or lower the height adjusters;

(c) a second tilting adjustment unit mounted on the base seat, the second tilting adjustment unit including multiple height adjusters and a second adjustment rod, wherein at least one height adjuster is mounted on the left side of the base seat and at least one height adjuster is mounted on the right side of the base seat, the second adjustment rod being mounted on the base seat, when the second adjustment rod is positioned in a first position, the second adjustment rod being drivingly connected with the height adjusters of the second tilting adjustment unit on the left side of the base seat to lift or lower the height adjusters, when the second adjustment rod is positioned in a second position, the second adjustment rod being drivingly connected with the height adjusters of the second tilting adjustment unit on the right side of the base seat to lift or lower the height adjusters;

(d) a teeing ground rested on and bridged between the height adjusters of the first and second tilting adjustment units; and (e) a tee holder unit fixedly disposed under the bottom face of the teeing ground, the tee holder unit including a fixing seat locked under the bottom of the teeing ground and a tee holder fitted in the fixing seat and extending through the teeing ground, a bottom end of the tee holder being coupled with a threaded rod, the threaded rod being screwed in a driven gear, which is drivable by a driving gear, the driving gear being drivingly rotatable by a rod body whereby a user can adjust the tee holder to a desired teeing height, a top end of the tee holder being formed with a socket in which a tee can be inserted.

11. A tiltable/adjustable golf practice device comprising:

(a) a base seat having a front side, a back side, a left side and a right side;

(b) a first tilting adjustment unit mounted on the base seat, the first tilting adjustment unit including multiple height adjusters and a first adjustment rod, wherein at least one height adjuster is mounted on the front side of the base seat and at least one height adjuster is mounted on the back side of the base seat, the first adjustment rod being mounted on the base seat, when the first adjustment rod is positioned in a first position, the first adjustment rod being drivingly connected with the height adjusters of the first tilting adjustment unit on the front side of the base seat to lift or lower the height adjusters, when the first adjustment rod is positioned in a second position, the first adjustment rod being drivingly connected with the height adjusters of the first tilting adjustment unit on the back side of the base seat to lift or lower the height adjusters;

(c) a second tilting adjustment unit mounted on the base seat, the second tilting adjustment unit including multiple height adjusters and a second adjustment rod, wherein at least one height adjuster is mounted on the left side of the base seat and at least one height adjuster is mounted on the right side of the base seat, the second adjustment rod being mounted on the base seat, when the second adjustment rod is positioned in a first position, the second adjustment rod being drivingly connected with the height adjusters of the second tilting adjustment unit on the left side of the base seat to lift or lower the height adjusters, when the second adjustment rod is positioned in a second position, the second adjustment rod being drivingly connected with the height adjusters of the second tilting adjustment unit on the right side of the base seat to lift or lower the height adjusters, two sets of height adjusters of the second tilting adjustment unit being respectively mounted on two corners of the left side of the base seat and two corners of the right side of the base seat, each of the height adjusters having a threaded rod rotatably mounted in pivot seats fixed on the base seat, one end of the threaded rod being connected with a driven gear, two slide blocks being screwed on the threaded rod, the slide blocks being synchronously axially movable along the threaded rod toward each other, the height adjuster further having a seat body, two side of the seat body being respectively pivotally connected to the slide blocks on the corresponding sides via links, the seat body serving to support the teeing ground; and (d) a teeing ground rested on and bridged between the height adjusters of the first and second tilting adjustment units.

12. The tiltable/adjustable golf practice device as claimed in claim 11, wherein the seat body is formed with an insertion slot, a connection member being inserted in the insertion slot, a threaded rod upward protruding from the connection member for locking with a support head, the support head having a domed top end correspondingly fitted in a dent under a bottom of the teeing ground for supporting the teeing ground.

13. The tiltable/adjustable golf practice device as claimed in claim 11, wherein the second adjustment rod is slidably rotatably mounted in a second pivot seat of the base seat, a left driving gear and a right driving gear being disposed on the second adjustment rod, when the second adjustment rod is slid to the first position, the left driving gear is directly or indirectly engaged with the driven gear of the height adjusters of the second tilting adjustment unit on the left side of the base seat, when the second adjustment rod is slid to the second position, the right driving gear is directly or indirectly engaged with the driven gear of the height adjusters of the second tilting adjustment unit on the right side of the base seat.

14. The tiltable/adjustable golf practice device as claimed in claim 13, wherein the second pivot seat has a latch section, the second adjustment rod being annularly formed a first latch groove and a second latch groove, when the second adjustment rod is positioned in the first position, the latch section of the second pivot seat being latched in the first latch groove of the second adjustment rod, when the second adjustment rod is positioned in the second position, the latch section of the second pivot seat being latched in the second latch groove of the second adjustment rod.

* * * * *